United States Patent [19]

Jakobi

[11] 4,438,571

[45] Mar. 27, 1984

[54] ARRANGEMENT FOR DRY COOLING OF COKE

[75] Inventor: Wilhelm Jakobi, Essen, Fed. Rep. of Germany

[73] Assignee: Krupp-Koppers GmbH, Essen, Fed. Rep. of Germany

[21] Appl. No.: 328,102

[22] Filed: Dec. 7, 1981

[30] Foreign Application Priority Data

Jan. 7, 1981 [DE] Fed. Rep. of Germany ..... 3100168

[51] Int. Cl.[3] ..... F26B 17/12

[52] U.S. Cl. ..... 34/65; 34/168; 34/211; 34/20; 202/228

[58] Field of Search ..... 34/168, 33, 211, 20, 34/65; 202/227, 228

[56] References Cited

U.S. PATENT DOCUMENTS 4,370,202 1/1983 Weber ..... 202/228

FOREIGN PATENT DOCUMENTS 3009818 1/1981 Fed. Rep. of Germany .

*Primary Examiner*—Larry I. Schwartz

*Attorney, Agent, or Firm*—Michael J. Striker

[57] ABSTRACT

An arrangement for dry cooling of coke has a prechamber for a coke to be cooled with a prechamber wall, a cooler with a cooler wall, a plurality of connecting members connecting these walls with each other, so that a cooling gaseous medium can pass between the connecting members, and a plurality of throttling elements arranged between the connecting members and actuated from outside of the walls.

10 Claims, 3 Drawing Figures

ARRANGEMENT FOR DRY COOLING OF COKE

BACKGROUND OF THE INVENTION

The present invention relates to an arrangement for dry cooling of coke.

Arrangements of the above-mentioned general type are known in the art. One of these arrangements is disclosed, for example, in the German Patent Application No. P 3,009,818.1. The arrangement disclosed in this reference has a prechamber with a reduced portion in the region of an outlet for a gaseous cooling medium, and a plurality of connecting members which are provided on an outer surface of the prechamber and uniformly distributed thereover so as to connect the prechamber wall with a cooler wall and to distribute the gaseous cooling medium. Finally, the cooler wall has upper and lower parts connected with one another by sliding joints and the prechamber wall is connected with the upper part of the cooler wall also by sliding joints. This construction is light and reliable and also is characterized by small consumption of refractory material. Repairs of the arrangement because of heat expansion, particularly during heating or cooling of the cooler are decreased. The gas stream outgoing from the coke to be cooled is sufficiently distributed and thereby the general flow conditions in the cooler are favorably influenced.

In connection with the latter mentioned advantage it has been determined that the connecting members which connect the chamber wall with the cooler wall provide for a certain uniformity of the flow of hot gas from the lower part of the cooler. Thereby, increased distribution of this gas over the entire cross-section of the annular space between the prechamber wall and the upper part of the wall of the cooler is attained. However, it is impossible to adjust the flow conditions in completely satisfactory manner to all variations and requirements which take place in practical operation of the arrangement.

SUMMARY OF THE INVENTION

Accordingly, it is an object of the present invention to provide an arrangement for dry cooling of coke which avoids the disadvantages of the prior art.

More particularly, it is an object of the present invention to provide an arrangement for dry cooling of coke which makes possible better adjustment of flow conditions of hot gas flowing upwardly in the cooling arrangement.

In keeping with these objects and with others which will become apparent hereinafter, one feature of the present invention resides, briefly stated, in an arrangement for dry cooling of coke having a prechamber, a cooler, and a plurality of connecting members connecting a prechamber wall with a cooler wall, wherein throttling means is arranged between the connecting members and actuated from outside of the walls.

When the arrangement is designed in accordance with the present invention the gas flow conditions in the cooling arrangement can be adjusted in correspondence with the variations and requirements existing in the arrangement during its operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

The drawings show only those parts of the arrangement which are required for understanding the inventive features. The upper part of the arrangement with a receiving means for receiving a coke to be cooled and a lower part of the arrangement with a discharging the cooled coke, as well as gas inlet pipes are not shown in the drawing.

DESCRIPTION OF PREFERRED EMBODIMENT

Figure 1:
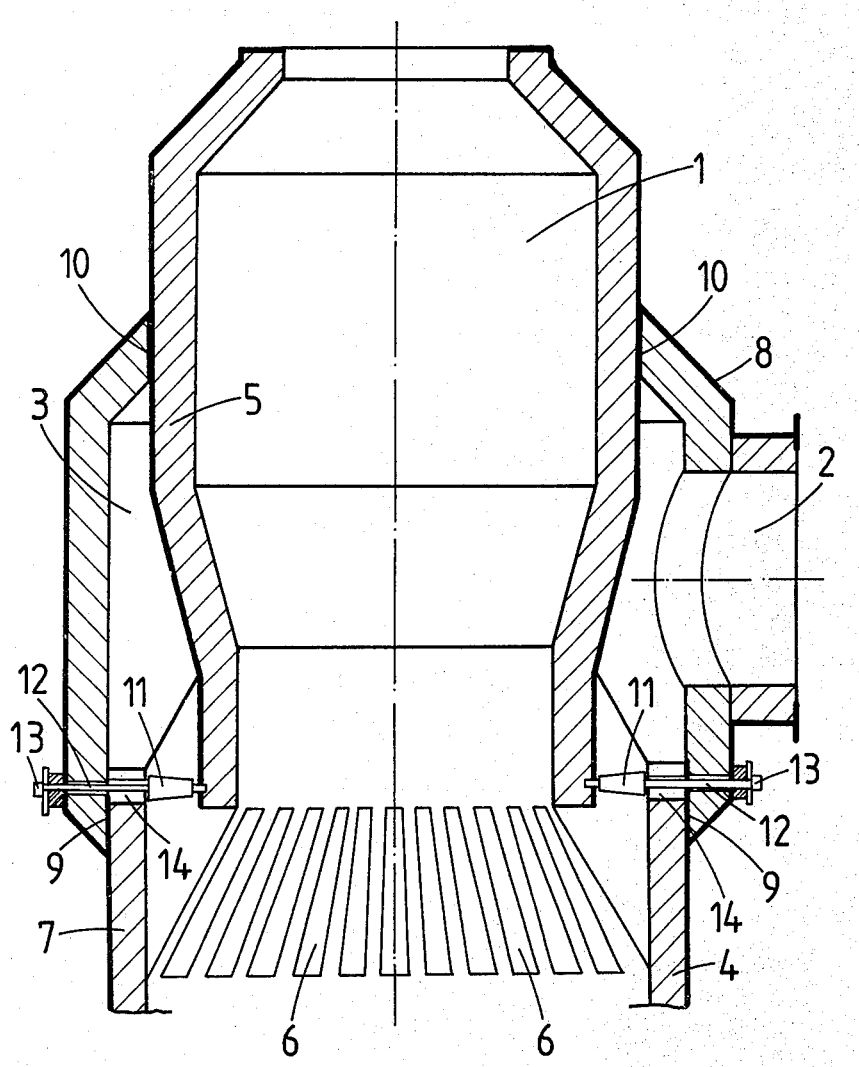
FIG. 1 is a view showing a longitudinal section of an arrangement for dry cooling of coke, in accordance with the present invention.

An arrangement for dry cooling of coke operates on a principle that a coke to be cooled is supplied from above downwardly and cooled by a counterstream of a gaseous cooling medium which flows upwardly into the coke to be cooled. The arrangement shown in FIG. 1 has a prechamber identified by reference numeral 1. A cooling element of the arrangement has an upper part which is identified by reference numeral 8 and forms together with the prechamber 1 an annular space 3. The annular space 3 is concentric relative to a central axis of the arrangement.

As can be seen from the drawing, the arrangement has a discharge pipe 2, and the prechamber 1 has a conically reducing portion in the region of the discharge pipe 2. Thereby, a free cross-section of the annular space 3 is increased at this location. The coke to be cooled is supplied from above downwardly and first enters the prechamber 1. When the coke exits from the prechamber 1, it forms a slope which closes the annular space 3 from below. A hot gas accumulates in the thus-formed slope before escaping via the discharge pipe 2 to a not shown aspirating device.

A wall 5 of the prechamber 1 is composed of a refractory material and provided with a plurality of connecting members or webs 6 outside of its lower part. The webs 6 are also composed of a refractory material. The webs 6 are uniformly distributed over the entire periphery of the prechamber 1 and connect the prechamber 1 with a wall 7 of a lower part 4 of the cooler. The webs 6 have two functions, namely, the function of supporting the prechamber 1 and the function of uniformly distributing the flow of hot gas which rises from the lower part 4 of the cooler so that the hot gas is better distributed over the entire cross-section of the annular space 3.

Sliding joints 9 are provided between the upper part 8 and the lower part of the cooler. Sliding joints 10 are also provided between the prechamber 1 and the upper part 8. This means that the cooler has in this case the identical outer diameter not over the entire height. Moreover, the outer diameter of the lower part 4 corresponds to the inner diameter of the upper part 8, so that during heating of the arrangement the lower part 4 can extend along the sliding joint 9 freely into the upper part 8. Since the sliding joints 10 are provided also between the prechamber 1 and the upper part 8, the upper part 8 must not change its position correspondingly as the lower part 4. This conditions naturally take place during cooling when the lower part 4 and thereby the prechamber 1 are subjected to shrinking. The sliding joints can be formed as those in conventional air heaters.

In accordance with the present invention the inventive arrangement has throttling valves 11 provided in free intermediate spaces between the webs 6. The throttling valves 11 are mounted on an axle 12. The axles 12 extend through the wall of the lower part 4 and the upper part 8 and terminate outside of the arrangement in an adjustment element 13. Thereby it is possible to adjust the position of the throttling valves 11 by turning of the adjustment elements 13 from outside. This adjustment is performed so as to change the free cross-section of the intermediate spaces between the webs 6 and thereby to influence the draw and pressure conditions in the arrangement.

For passing the axles 12 through the wall 7 of the lower part 4, an opening 14 is provided in the wall 7 and the sliding joint 9. This is required in order to arrange the axles in such a manner as not to affect the operation of the sliding joint 9 and guarantee, despite the arrangement of the axle 12 in its region, that the movement of the lower part 4 and the upper part 8 can still take place. The arrangement of the throttling valves 11 is shown in the drawing only to illustrate the inventive principle. Naturally other constructions of throttling means are possible including, for example, such constructions in which complete passage of the axle 12 through the respective walls can be dispensed with.

Figure 2:
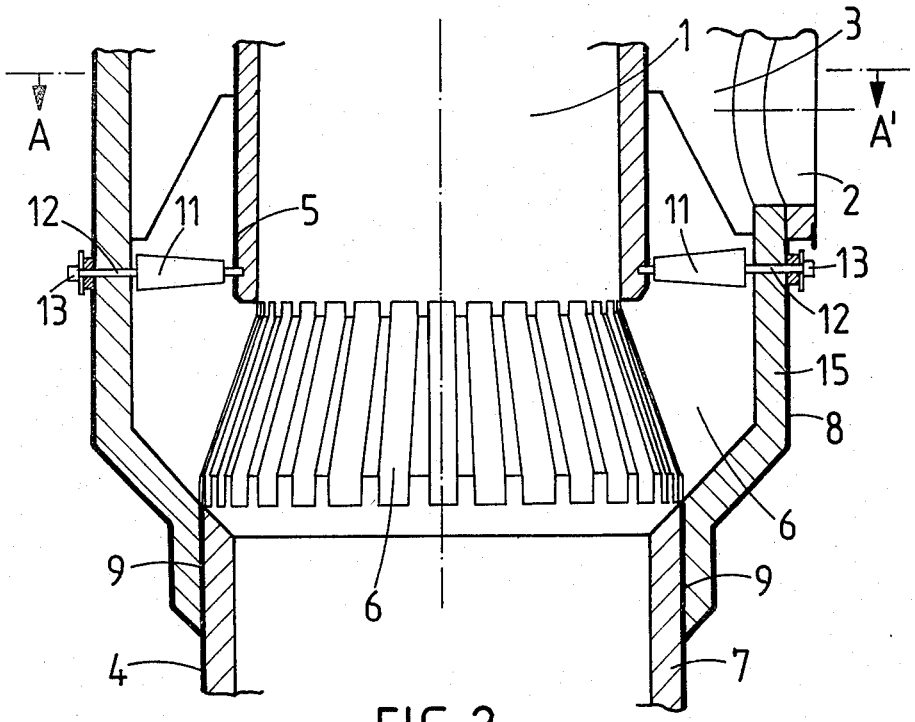
FIG. 2 is a view substantially corresponding to the FIG. 1 but showing an arrangement for dry cooling of coke in accordance with a further embodiment of the invention.

The cooling arrangement in accordance with another embodiment of the invention is shown in FIG. 2. This arrangement differs from the arrangement of shown in FIG. 1 by the fact that the prechamber 1 is connected here by the webs 6 not with the lower part 4 but with the upper part 8 of the cooling element. Thereby, the axles 12 of the throttling valves 11 must not be arranged in the region of the sliding joints 9, but instead extend only through a wall 15 of the upper part 8 so that the construction of the arrangement is simpler. All other parts of the arrangement shown in FIG. 2 are identical to the arrangement shown in FIG. 1.

Figure 3:
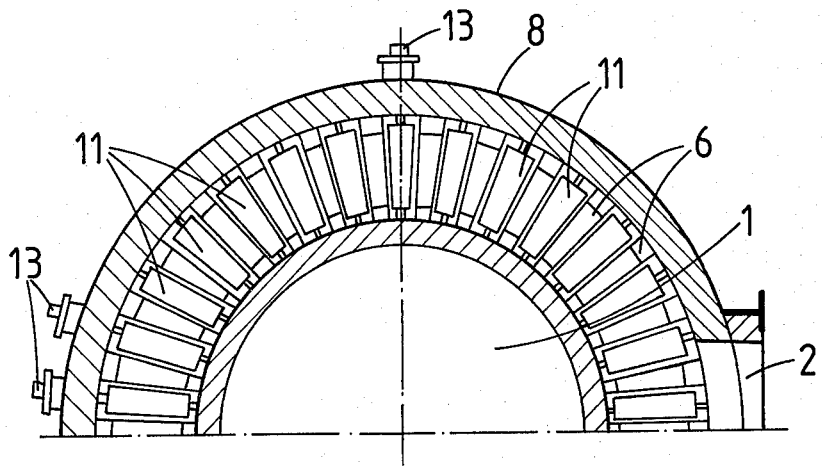
FIG. 3 is a view showing a section taken along the line A—A in FIG. 2, wherein only part of the section is shown.

FIG. 3 shows a section taken along the line A—A' in FIG. 2 with only one half of the section illustrated. This Figure shows the arrangement of the throttling valve 11 between the webs 6, and the adjusting elements 13. Only three adjusting elements 13 are shown in this Figure for the sake of clarity. In normal case, each throttling valve 11 has the adjusting element 13. In FIG. 3 all intermediate spaces between the web 6 are provided with the throttling valve 11. It is of course possible to provide only one half or one-third of the intermediate spaces between the webs 6 with the throttling elements 11. Then it is possible thereby to attain adjustment of the gas stream rising in the cooling arrangement in desired manner.

It will be understood that each of the elements described above, or two or more together, may also find a useful application in other types of constructions differing from the types described above.

While the invention has been illustrated and described as embodied in an arrangement for dry cooling of coke, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for dry cooling of coke, comprising means forming a prechamber for a coke to be cooled and having a substantially cylindrical prechamber wall with an axis; cooling means arranged below said prechamber forming means and having a substantially cylindrical cooler wall, an upper portion of said cooler wall surrounding a lower portion of said prechamber wall; means for connecting said prechamber walls with said cooler wall and including a plurality of connecting members spaced from each other and connecting said walls with each other so that a cooling gaseous medium can pass between said connecting members; throttling means arranged between said connecting members and actuated from outside of said walls; and actuating means extending substantially radially through said cooler wall from outside inwardly of the latter so as to actuate said throttling means.

2. An arrangement as defined in claim 1; and further comprising an outlet for the gaseous cooling medium, said prechamber wall having a reducing portion in the region of said outlet.

3. An arrangement as defined in claim 1, wherein said prechamber wall has an outlet portion and a periphery, said connecting members being arranged in the region of said outlet portion and on said periphery of said prechamber wall.

4. An arrangement as defined in claim 1, wherein said cooler wall has an upper cooler wall part and a lower cooler wall part, said connecting members connecting said prechamber wall with one of said cooler wall parts.

5. An arrangement as defined in claim 4; and further comprising sliding joints connecting said upper cooler wall part with said lower cooler wall part.

6. An arrangement as defined in claim 5; and further comprising sliding joints connecting said prechamber wall with said one cooler wall part.

7. An arrangement as defined in claim 1, wherein said cooler wall part has a periphery, said throttling means includes a plurality of throttling elements distributed over the entire periphery of said cooler wall.

8. An arrangement as defined in claim 7, wherein said actuating means includes a plurality of axles extending through said cooler wall and each supporting a respective one of said throttling elements, and a plurality of adjusting elements located outside of said cooler wall and acting upon said axles so as to adjust positions of said throttling elements.

9. An arrangement as defined in claim 7, wherein said throttling elements of said throttling means are uniformly distributed over the entire periphery of said cooler wall.

10. An arrangement as defined in claim 1; and further comprising means for actuating said throttling means so as to vary aspiration and pressure conditions in said cooling means.

* * * * *